United States Patent [19]

Ikemura et al.

[11] Patent Number: 4,664,024

[45] Date of Patent: May 12, 1987

[54] THERMALLY INSULATED WINDOW WITH VENTILATION DUCTS

[75] Inventors: Akio Ikemura, Kurobe; Minoru Kajiki, Toyama, both of Japan

[73] Assignee: Yoshida Kogyo K.K., Tokyo, Japan

[21] Appl. No.: 753,610

[22] Filed: Jul. 10, 1985

[30] Foreign Application Priority Data

Jul. 10, 1984 [JP] Japan ..... 59-104175[U]

[51] Int. Cl.[4] ..... F24F 13/18

[52] U.S. Cl. ..... 98/88.1; 98/33.1; 98/41.1; 98/116

[58] Field of Search ..... 52/209; 98/32, 33.1, 98/41.1, 88.1, 94.1, 94.2, 97, 99.6, 116

[56] References Cited

U.S. PATENT DOCUMENTS

| | | | |
|---|---|---|---|
| 3,977,466 | 8/1976 | Johansson | 98/116 X |
| 4,437,868 | 3/1984 | Kuhlman | 98/116 X |
| 4,558,638 | 12/1985 | Rock et al. | 98/88.1 |

FOREIGN PATENT DOCUMENTS

| | | | |
|---|---|---|---|
| 2546113 | 4/1977 | Fed. Rep. of Germany | 98/94.1 |
| 2942482 | 4/1981 | Fed. Rep. of Germany | 98/88.1 |

*Primary Examiner*—Harold Joyce

*Attorney, Agent, or Firm*—Hill, Van Santen, Steadman & Simpson

[57] ABSTRACT

A thermally insulated window includes intake and discharge ducts extending between a pair of interconnected interior and exterior metallic frame pieces, and dampers pivotably mounted on the ducts to open and close openings of the ducts which face the outside atmospheric air. The ducts and the dampers are made of a thermally insulative material such as a synthetic resin. The dampers are actuated by power transmitting mechanisms which are disposed within the respective ducts and are adapted to be actuated from the interior side of the window. The ducts, dampers and the power transmitting mechanisms do not deteriorate the thermal insulating properties of the window as a whole.

1 Claim, 6 Drawing Figures

THERMALLY INSULATED WINDOW WITH VENTILATION DUCTS

BACKGROUND OF THE INVENTION

1. Field of the Invention

The present invention relates to thermally insulated windows for use in a curtain wall of a house or building, and more particularly to a thermally insulated window having ventilation ducts.

2. Prior Art

Thermally insulated windows composed of metallic shapes or sections, such as extruded aluminum shapes are known, in which a window sash or frame comprises interconnected interior and exterior pairs of such metallic shapes and thermally insulating connectors of synthetic resin or rubber interposed between the interior and exterior frame pieces, with panes of glass or other thermally insulating panels mounted within the window frame.

The known thermally insulated window has a drawback in that where a ventilation duct is provided in the window frame for communication between the room interior and the outside atmosphere, the thermal insulation in the vicinity of the duct becomes insufficient. This condition exists because the duct which extends between the metallic interior and exterior shapes tends to break a thermally insulated relation between the interior and exterior shapes and hence to make a thermal path therebetween. With the thermal path thus completed, a considerable amount of heat energy is transferred from the room interior to the outside air through such thermal path, thereby lowering the room air conditioning efficiency. Furthermore, during winter season when cold outside air is introduced through the duct into the heated room interior, the interior shapes become wet with condensation from room air which will cause a lowering of thermal insulating properties of the window. In order to avoid air exchange through the duct when the ventilation is not effected, there may be provided on the exterior side of the duct a pivotable valve or damper which is actuatable to open and close the duct through a power transmitting mechanism such as a link mechanism composed of a plurality of metallic links. In assembling such metallic links with the duct, care must be taken not to damage a thermal insulation between the interior side of the window and the exterior side of the window.

SUMMARY OF THE INVENTION

It is therefore an object of the present invention to provide a thermally insulated window having ducts which overcome or substantially eliminate the drawbacks of the prior comparable windows.

A more specific object of the present invention is to provide a thermally insulated window having intake and discharge ducts which are mounted in the window without deteriorating the thermal insulating properties of the entire window and which is adapted to be opened and closed by dampers provided on the exterior side of the ducts.

The foregoing and other objects of the present invention are attained by a thermally insulated window for a building which comprises intake and discharge ducts extending between a pair of interconnected interior and exterior metallic frame pieces of a window frame or sash, and dampers pivotably mounted on the ducts to open and close openings of the ducts which face the outside atmospheric air. The ducts and the dampers are made of a thermally insulated material such as a synthetic resin. The dampers are actuated by power transmitting mechanisms which are disposed within the respective ducts and are adapted to be actuated from the interior side of the window. The ducts, dampers and the power transmitting mechanisms do not deteriorate the thermal insulating properties of the window as a whole. Thus, an increased degree of room air conditioning efficiency is attainable.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 2:
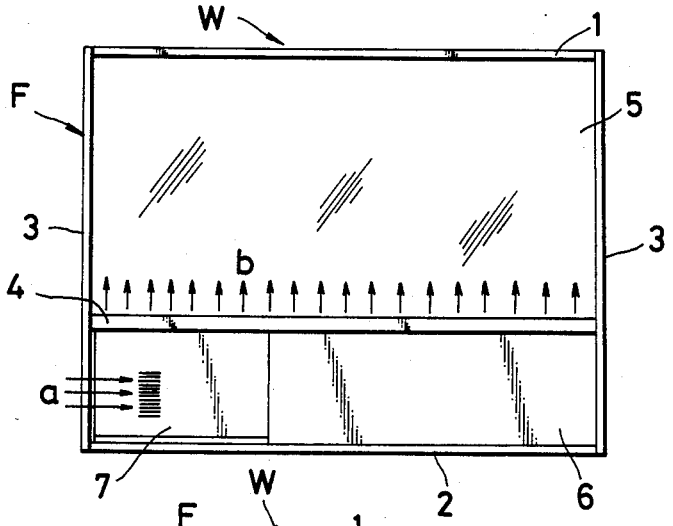
FIG. 2 is a schematic front elevational view, on reduced scale, of the thermally insulated window, the view showing the window as seen from the interior of a room.
Figure 3:
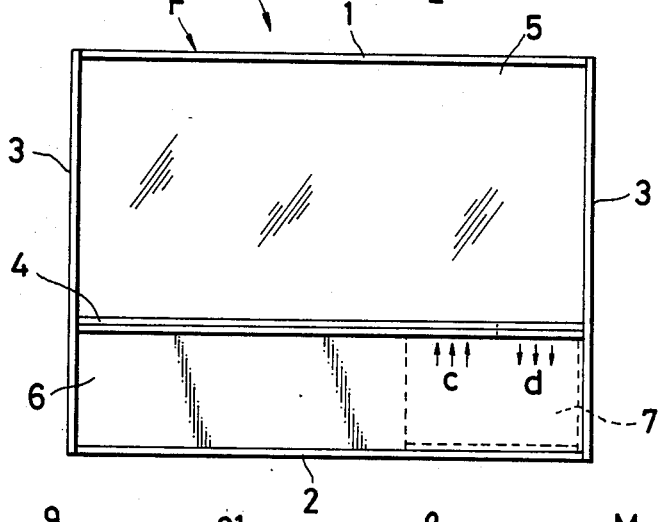
FIG. 3 is a view similar to FIG. 2, showing the thermally insulated window as seen from the exterior of the room.

As shown in the drawings, wherein like reference characters designate identical or corresponding parts throughout several views, and more particularly in FIGS. 2 and 3, there is shown a thermally insulated window W embodying the present invention.

The thermally insulated window W includes an open rectangular window frame F mounted in an opening of a building (not shown). The window frame F includes top and bottom horizontal frame members 1, 2 connected at opposite ends with left and right vertical frame members 3, 3, and an intermediate horizontal frame member or a transom 4 extending between the vertical frame members 3, 3 to define a pair of upper and lower openings within the window frame F. The transom 4 is positioned more closely to the bottom horizontal frame member 2 than to the top horizontal frame member 1. A pane of glass 5 is mounted within the upper opening, and a thermally insulated panel 6 is mounted within the lower opening, the glass pane 5 and the panel 6 jointly constituting a thermally insulated panel element. A ventilator 7 is supported within the window frame F, the ventilator 7 having a built in heat-exchanging element or rotor (not shown) which is capable of exchanging both sensitive heat and latent heat at the same time.

Consumed room air is drawing into the ventilator 7 as indicated by the arrows a in FIG. 2 and then it is discharged from an outlet (not shown) to the outside atmosphere as indicated by the arrows d in FIG. 3. Fresh atmospheric air is drawing from an inlet (not shown) into the ventilator 7 as indicated by the arrows c in FIG. 3 and then it is discharged from the transom 4 to the room interior as indicated by the arrows b in FIG. 2. The fresh atmospheric air and the consumed room air are brought into heat-exchange relationship as they flow through the heat-exchanging rotor in the ventilator 7.

Figure 1:
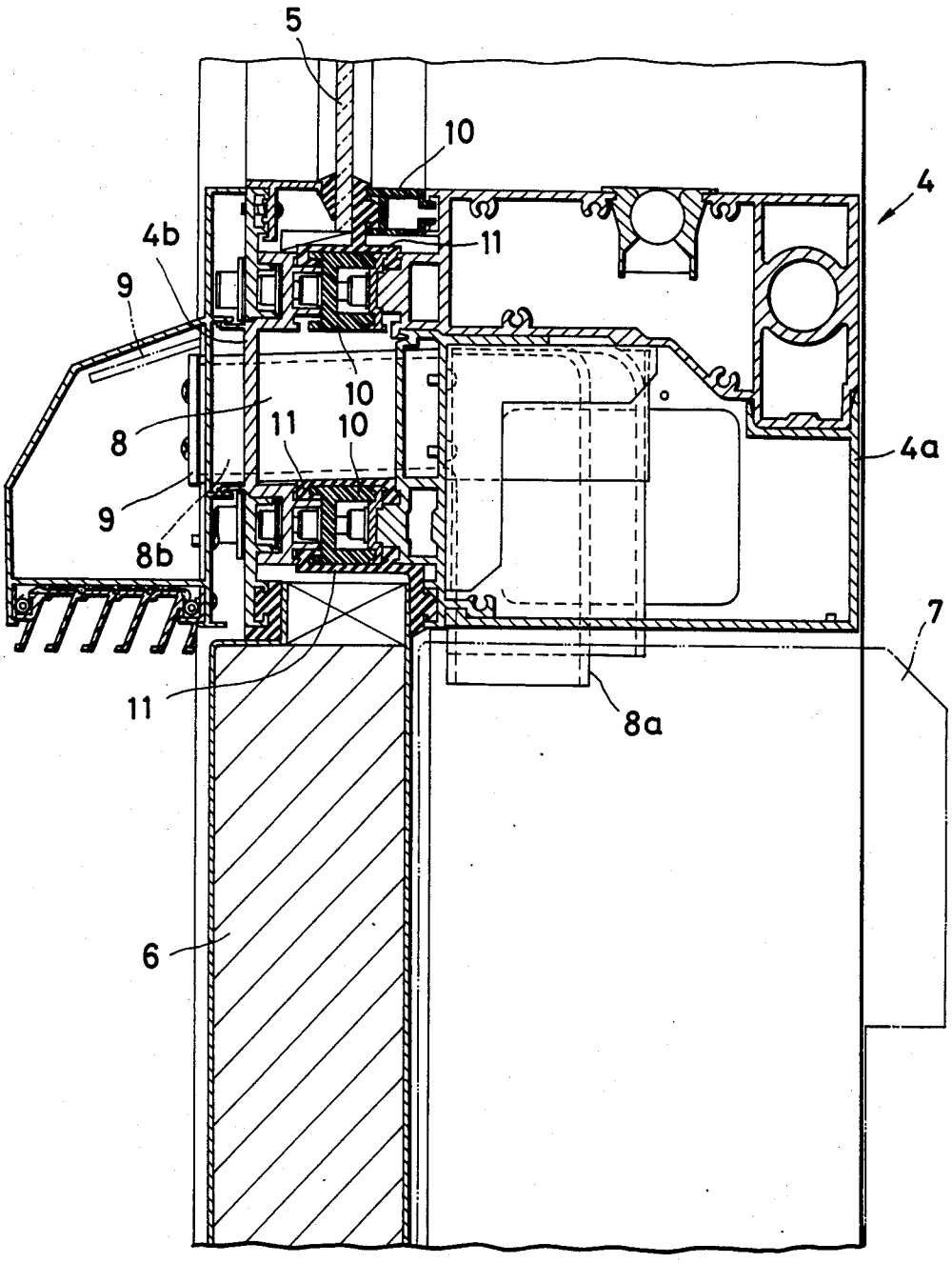
FIG. 1 is a vertical cross-sectional view of a portion of a thermally insulated window according to the invention, the view showing a transom and a ventilation duct mounted therein.

As shown in FIG. 1, the transom 4 comprises a pair of interior and exterior frame pieces 4*a*, 4*b* interconnected with connectors 10, 11 interposed therebetween. The frame pieces 4*a*, 4*b* are made of extruded aluminum shapes or sections while the connectors 10, 11 are made of a thermally insulating material such as a synthetic resin or rubber. Thus, the transom 4 has a thermally insulated construction. Although not shown, the top and bottom horizontal frame members 1, 2 and the vertical frame members 3, 3 also have a thermally insulated construction and each includes a pair of interior and exterior frame pieces of extruded aluminum shapes interconnected with thermally insulating connectors interposed therebetween. As described above, the glass pane 5 and the thermally insulated panel 6 are mounted within the window frame F as a thermally insulated panel element. Thus, the window W as a whole has a thermally insulated construction.

The transom 4 has a pair of intake and discharge ducts 8 (only one being shown) juxtaposed in a longitudinal direction of the transom. These ducts have the same construction and only the discharge duct 8 is described below. The duct 8 has a generally inverted L-shape and extends through the interior and exterior frame pieces 4*a*, 4*b*. The duct 8 is made of a thermally insulative material, such as a synthetic resin so that it does not create a negative influence on the thermal insulating properties of the window W as a whole. The duct 8 has an interior end portion 8*a* connected with the ventilator 7 and a discharge opening 8*b* which is closed and opened by a valve means or damper 9 pivotably mounted on the duct 8 adjacent to the opening 8*b*. The damper 9 is made of a thermally insulative material such as a synthetic resin and is actuated through a power transmitting mechanism described below.

Figure 4:
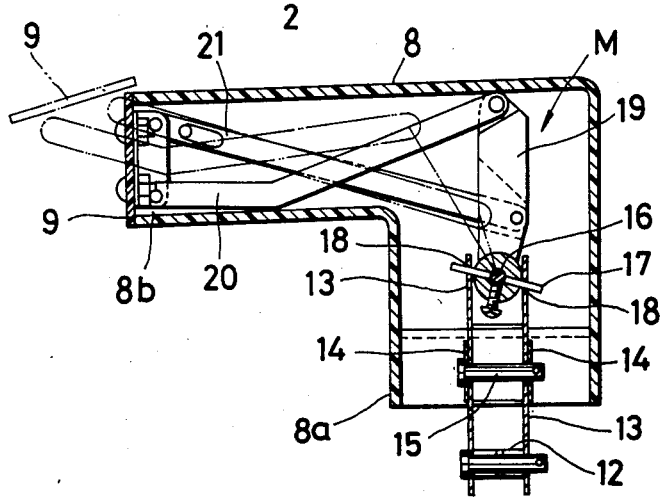
FIG. 4 is a vertical cross-sectional view of the ventilation duct shown in FIG. 1, the view illustrating the operation of a damper actuation mechanism mounted within the duct.
Figure 5:
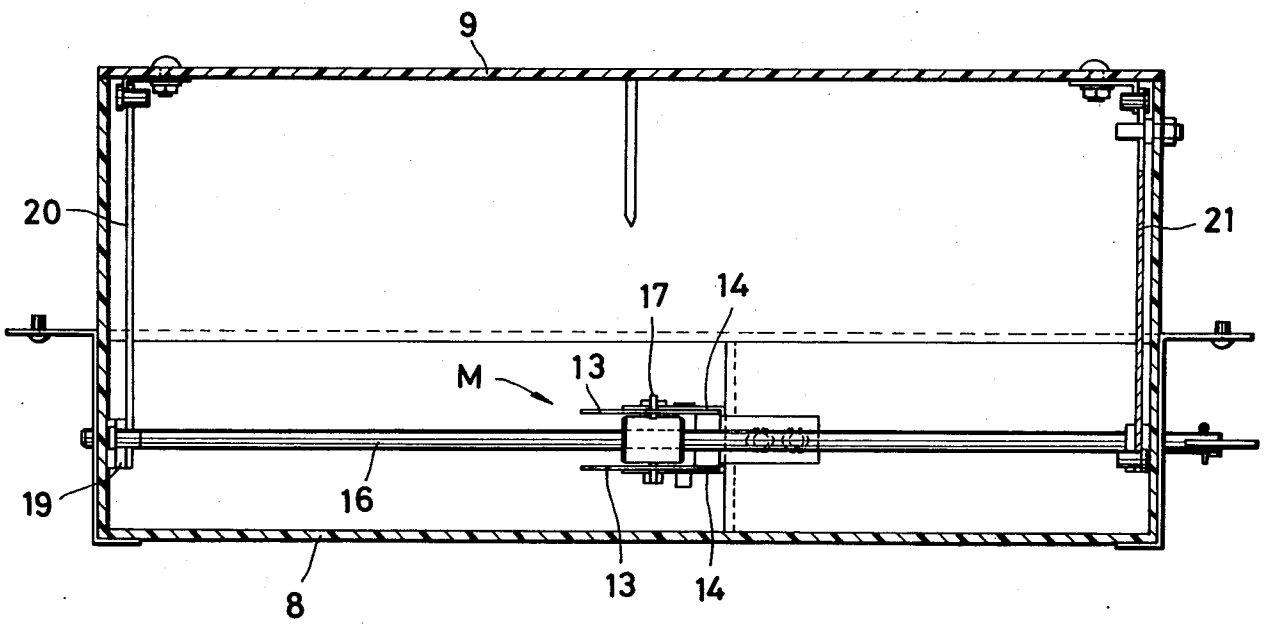
FIG. 5 is an enlarged horizontal cross-sectional view of the duct, with parts omitted for clarity.
Figure 6:
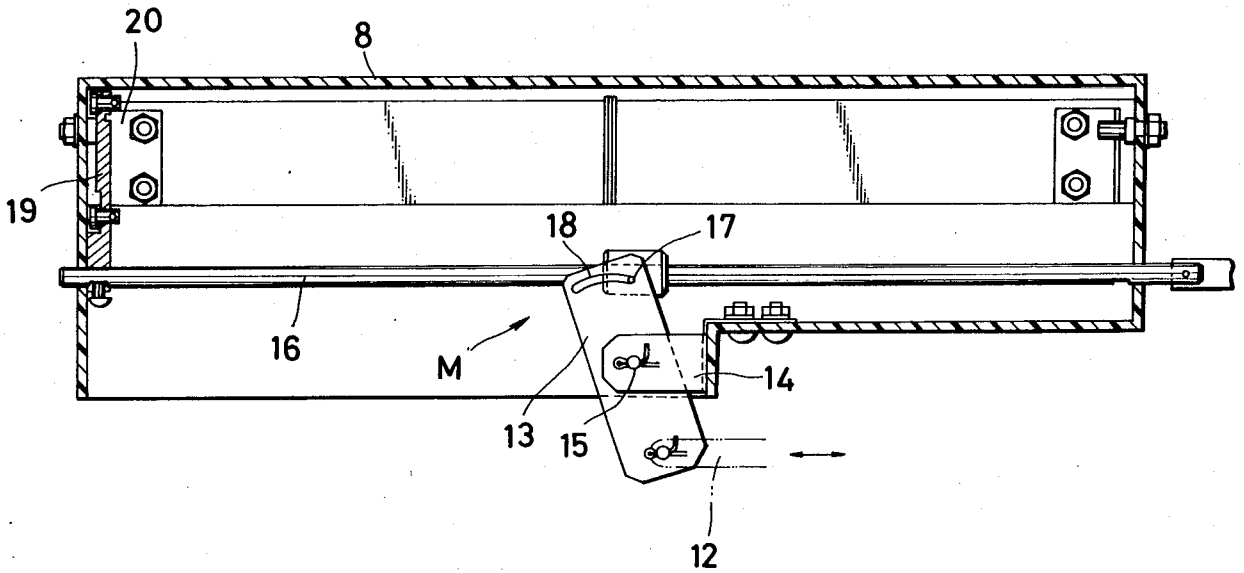
FIG. 6 is an enlarged vertical cross-sectional view taken in a plane perpendicular to the plane of FIG. 4.

As shown in FIGS. 4 to 6, the power transmitting mechanism comprises a link mechanism M disposed within the duct 8 and actuatable to open and close the damper 9 in response to the movement of an actuator rod 12 which is operatively connected to a select switch (not shown) adapted to be actuated by an occupant of the room. The link mechanism M includes a pair of parallel spaced rocking levers 13, 13 centrally pivoted by a pin 15 to a pair of support plates 14, 14 secured to the interior end portion 8a of the duct 8. The rocking levers 13, 13 have lower end portions pivotably connected by a pin (not designated) to the actuator rod 12 so that they are pivotally movable in vertical planes, respectively, in response to the reciprocation of the actuator rod 12. The link mechanism M also includes a horizontal shaft 16 rotatably mounted on and extending transversely through the duct 8, the shaft 16 lying in a plane parallel to the plane of the window. The shaft 16 has a rocking pin 17 extending perpendicularly therethrough and received at opposite ends thereof in a pair of arcuate guide slots 18 which are formed in the upper end portions of the respective rocking levers 13, 13. The arcuate guide slots 18, 18 are vertically offset or staggered from one another. With this pin-and-slot connection, a pivotal motion of the levers 13, 13 is converted to a rocking motion of the shaft 16 and driving power is transferred between two non-intersecting, non-parallel axes. A connecting lever 19 is secured at one end thereof to one end of the shaft 16 for pivotal movement in a vertical plane which is perpendicular to the vertical planes of the movement of the levers 13, 13. A pair of actuation links 20, 21 is connected to the connecting lever 19 and the damper 9. Stated more specifically, the lever 20 is pivotably connected at one end to the upper end of the connected lever 19 and at the other end to a lower end of the damper 9. The lever 21 is pivotably connected at one end to an intermediate portion of the connecting lever 19 and at the other end to the upper end of the damper 9. Although not shown, a connecting lever and a pair of links are disposed in the duct 8 in opposite relation to the corresponing elements 19, 20, 21.

With the link mechanism M thus constructed, when the damper 9 is to be opened, the actuator rod 12 is operated to move leftwardly in FIG. 6, whereupon the the rocking levers 13, 13 pivot clockwise. This pivotal motion causes the shaft 16 to turn counterclockwise in FIG. 4 whereupon the link 20 is urged outwardly from the discharge opening 8*b* of the duct 8. Thus, the damper 9 pivots to an open position indicated by phantom lines in FIG. 4. The damper 9 moves to the closing position indicated by solid lines in this figure in response to the movement of the actuator rod 12 toward the rightward direction in FIG. 6.

The thermally insulated window thus constructed has various advantages. The ducts and the dampers are made of a thermally insulative material such as a synthetic resin. The dampers are actuated by the power transmitting mechanisms such as link methanisms which are disposed in the respective ducts and are adapted to be actuated from the room interior side of the window. The ducts, dampers and power transmitting mechanisms do not deteriorate the thermal insulating properties of the window as a whole with the result that an increased degree of room air conditioning effeciency is attainable.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A thermally insulated window for building, comprising:

(a) a thermally insulated window frame and a thermally insulated panel element supported within said window frame, said window frame including a pair of interconnected interior and exterior frame pieces and thermally insulating connectors interposed between said interior and exterior frame pieces;

(b) a pair of intake and discharge ducts mounted on said frame and extending between said interior and exterior frame pieces for communication between outside atmospheric air and inside air of the building, said intake and discharge ducts being made of synthetic resin and having intake and discharge openings facing the outside atmospheric air;

(c) a pair of dampers made of synthetic resin and pivotably mounted on said intake and discharge ducts, respectively, adjacent to said intake and discharge openings to open and close the latter; and (d) a pair of power transmitting mechanisms disposed in said intake and discharge ducts, respectively, and operatively connected to said dampers to pivot the latter, said power transmitting mechanisms being actuatable from the inside of the building, each said power transmitting mechanism including (1) an actuator rod movable in a horizontal plane and adapted to be operated from the inside of the building, (2) a pair of rocking levers pivotably connected at their one ends to said actuator rod and pivotably movable in vertical planes, said rocking levers having a pair of arcuate gide slots defined respectively adjacent to their opposite ends in vertically staggered relation to one another, (3) a horizontal shaft rotatably mounted on and extending transversely through each said duct, (4) a rocking pin extending diametrically through said shaft and received at its opposite ends in said arcuate guide slots, (5) at least one connecting lever secured at its one end to said shaft for pivotal movement in a vertical plane which is perpendicular to said vertical planes of movement of said rocking levers, (6) a first actuation link pivotably connected at one end to the opposite end of said connecting lever and at the other end to each said damper adjacent to a free end of the latter, and (7) a second actuation link pivotably connected at one end to an intermediate portion of said connecting lever and at the other end to said damper adjacent to a pivoted end of the latter.

* * * * *